US005838763A

United States Patent [19]

Hiller et al.

[11] Patent Number: 5,838,763

[45] Date of Patent: Nov. 17, 1998

[54] X-RAY TUBE WITH A PLAIN BEARING

[75] Inventors: Bernhard Hiller, Buckenhof; Roland Koeppel; Edwin Gemmel, both of Erlangen, all of Germany

[73] Assignee: Siemens Aktiengesellschaft, Munich, Germany

[21] Appl. No.: 896,440

[22] Filed: Jul. 18, 1997

[30] Foreign Application Priority Data

Jul. 26, 1996 [DE] Germany ..... 196 30 351.6

[51] Int. Cl.[6] ..... H01J 35/10

[52] U.S. Cl. ..... 378/133; 378/132

[58] Field of Search ..... 378/132, 133, 378/131, 119, 121, 125, 127, 130, 144

[56] References Cited

U.S. PATENT DOCUMENTS 3,942,059 3/1976 Tran-Quang ..... 378/132 X
4,357,555 11/1982 Gerkema et al. ..... 378/132 X
4,856,039 8/1989 Roelandse et al. ..... 378/133
5,077,776 12/1991 Vetter .
5,189,688 2/1993 Ono et al. .
5,210,781 5/1993 Ono et al. .
5,541,975 7/1996 Anderson et al. ..... 378/133 X

*Primary Examiner*—David P. Porta
*Attorney, Agent, or Firm*—Hill & Simpson

[57] ABSTRACT

An X-ray tube has a rotating anode and a plain bearing for mounting the rotating anode in a vacuum housing. The plain bearing has an inner bearing part that is stationary in relation to the vacuum housing, and a rotating outer bearing part that is connected with the rotating anode and that rotates with this anode relative to the vacuum housing during the operation of the X-ray tube. Between these inner and outer bearing parts there is a bearing gap filled with lubricant at least in the region provided for the transmission of force. The inner bearing part, which extends through the outer bearing part, is connected to the vacuum housing at both ends. The bearing gap has the same outer diameter at each of its two ends.

4 Claims, 5 Drawing Sheets

X-RAY TUBE WITH A PLAIN BEARING

BACKGROUND OF THE INVENTION

1. Field of the Invention

The present invention is directed to an X-ray tube of the type having a rotating anode and a plain bearing provided for mounting the rotating anode in vacuum housing.

2. Description of the Prior Art

In known X-ray tubes of this type, the plain bearing has an inner bearing part that is stationary in relation to the vacuum housing and a rotating outer bearing part that is connected with the rotating anode and that rotates with this anode relative to the vacuum housing during the operation of the X-ray tube, into which outer bearing part the inner bearing part extends. A bearing gap, filled with lubricant at least in the region provided for the transmission of force, is present in the region in which the outer bearing part surrounds the inner bearing part.

It is undesirable for the plain bearing to lose lubricant in X-ray tubes of this sort. This is because, as a rule, alloys of gallium, of indium or of tin are used conventionally as liquid metal lubricants, which are liquid at room temperature, and which are highly reactive substances. Since the plain bearing is located in the interior of the vacuum housing, liquid metal escaping from the plain bearing is particularly harmful, since drops of liquid metal can reduce the high-voltage strength of the X-ray tube if they leave the anode region.

To address this concern, it is known to construct the plain bearing for mounting the rotating anode in a form which is open on one side, as described in German OS 38 42 034, U.S. Pat. Nos. 5,189,688 and 5,210,781. This means that the inner bearing part is housed in a blind bore of the outer bearing part, and the bearing gap is thus connected with the surrounding environment only at one end, i.e., in the region in which the inner bearing part comes out of the outer bearing part. During the operation of a plain bearing of this sort, a centrifugal force field acts on the lubricant located between the base surface of the blind bore of the outer bearing part and the frontal surface, lying opposite, of the inner bearing part. This force causes lubricant to move radially outwardly until, with reference to the effective centrifugal force, an equilibrium momentum condition is reached by the lubricant located in the bearing gap. In the course of this movement toward equilibrium, lubricant can escape from the bearing gap. In the plain bearings known from U.S. Pat. Nos. 5,189,688 and 5,210,781, measures are thus taken to counteract escape of the liquid metal from the plain bearing.

SUMMARY OF THE INVENTION

An object of the present invention is to provide a plain bearing of the type described above wherein the danger of an escape of lubricant is reduced.

According to the invention, this object is achieved in an X-ray tube with a rotating anode and a plain bearing for mounting the rotating anode in a vacuum housing, the plain bearing having an inner bearing part that is stationary in relation to the vacuum housing and which is connected at both ends to the vacuum housing, and a rotating outer bearing part that is connected with the rotating anode and that rotates with this anode relative to the vacuum housing during the operation of the X-ray tube, the inner bearing part extending through the outer bearing part, with a bearing gap, filled with lubricant at least in the region provided for the transmission of force, in the region in which the outer bearing part surrounds the inner bearing part, the gap having the same outer diameter at each of its two ends.

The plain bearing provided in the inventive X-ray tube is thus constructed so as to be open on both sides and it would therefore be assumed that this would lead to an increased escape of lubricant, i.e., because the inner bearing part protrudes out of the bore of the outer bearing part on both sides. The fact that, on the contrary, the danger of loss of lubricant is reduced in relation to a plain bearing constructed so as to be open only on one side is achieved because the bearing gap has the same outer diameter at each of its two ends. With respect to the centrifugal force field that arises during operation of the X-ray tube, it is thus the case a priori that no differences in energy potential (i.e., no net outward momentum) can occur in the lubricant that could lead to escape of lubricant from the bearing gap. On the contrary, in the plain bearing of the inventive X-ray tube care is even taken that during operation of the plain bearing the lubricant collects in the regions of the bearing gap that are involved in the transmission of force, due to the effect of the centrifugal force field. In addition, the inventive X-ray tube has the advantage that, due to the fastening at both sides of the inner bearing part to the vacuum housing, a rigid support of the rotating anode can be realized.

DESCRIPTION OF THE PREFERRED EMBODIMENTS

Figure 1:
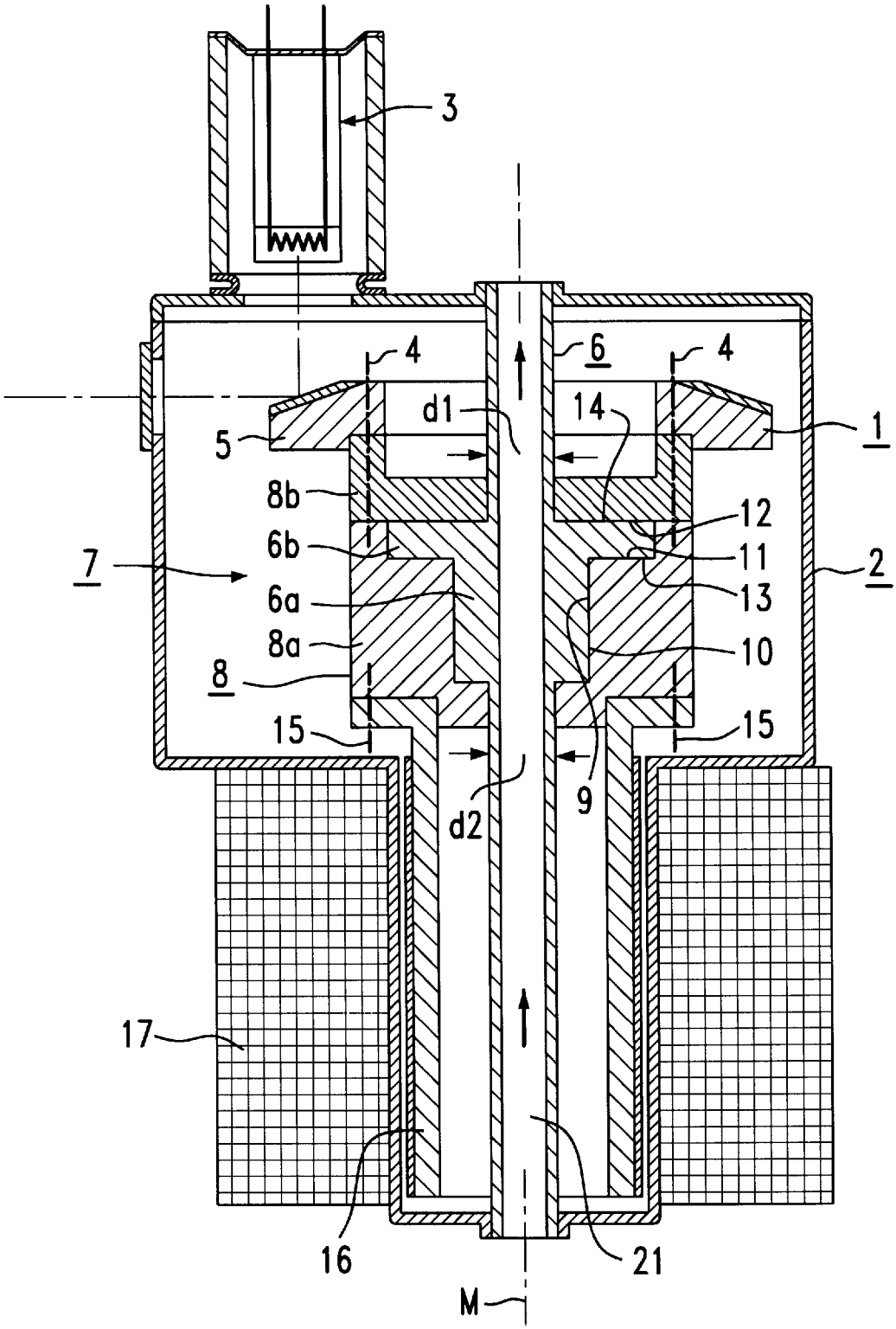
FIG. 1 shows a side view, partly in section of a first embodiment of an inventive rotating anode X-ray tube with a liquid metal plain bearing.

FIG. 1 shows a rotating anode X-ray tube having a rotating anode 1 housed in a vacuum housing 2. The vacuum housing 2 also contains a cathode arrangement 3 of known construction that contains thermionic filaments housed in a concentrating cup, indicated in rough schematic fashion.

In order to ensure a reliable rotatable mounting of the rotating anode 1, a plain bearing generally designated 7, is provided, which has as an inner bearing part, a bearing journal 6 connected fixedly at both ends with the vacuum housing 2. By means of screws, the anode plate 5 of the rotating anode 1 is firmly attached to the outer bearing part 8, which rotates during the operation of the X-ray tube (in FIG. 1 only the center lines of two screws, designated 4, are shown).

Figure 2:
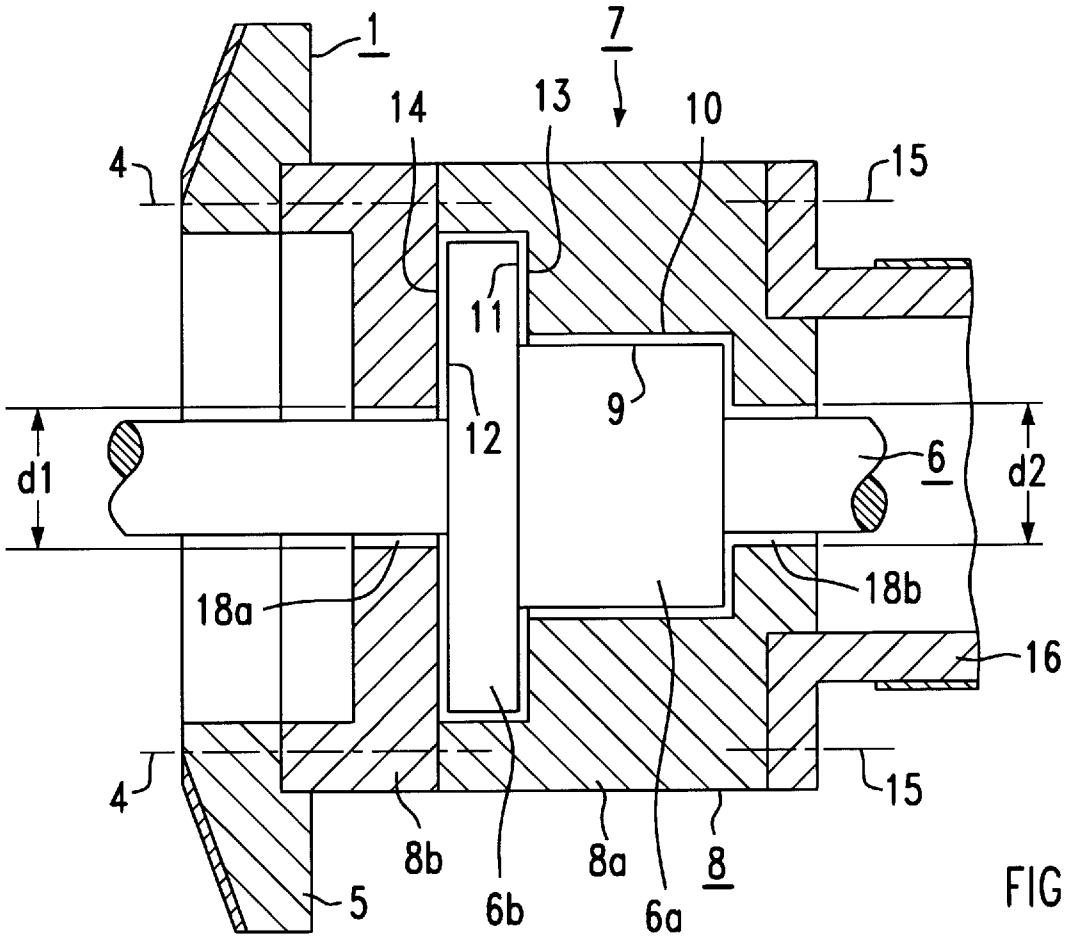
FIG. 2 shows an enlarged portion, partly in section, of the liquid metal plain bearing of the rotating anode X-ray tube according to FIG. 1.

As can be seen from FIG. 1 in combination with FIG. 2, the bearing journal 6 is thickened in its region enclosed in the bore of the outer bearing part 8. In this region, the bearing journal 6 has a first, substantially cylindrical segment 6*a*, to which a second segment, in the form of a flange 6*b* directed radially outwardly, is connected. The bearing journal 6 extends through the bore, which is open on both sides, of the outer bearing part 8, which is composed of two parts 8*a* and 8*b*. The journal 6 is surrounded in this bore in such a way that a cylindrical bearing surface pair, formed by the bearing surface 9 of the bearing journal 6 and the bearing surface 10 of the outer bearing part 8, is produced for the transmission of radial forces in relation to the rotational axis of the plain bearing 7, which is identical with the mid-axis M of the rotating anode 1. Two circularly annular bearing surface pairs are also produced, formed by the bearing surfaces 11 and 12 belonging to the bearing journal 6 and with the bearing surfaces 13 and 14 belonging to the outer bearing part 8, for the transmission of forces directed axially with respect to the mid-axis M. The outer diameter of each of the surface pairs 11 and 12, and 13 and 14, is greater than that of the bearing surfaces 9 and 10.

The bearing gap located between the bearing journal 6 and the outer bearing part 8 is filled with a liquid lubricant, in a way not shown in FIG. 1, at least in its region provided for transmission of force, i.e. between the bearing surfaces 9, 11 and 12 of the bearing journal 6 and the bearing surfaces 10, 13 and 14 of the outer bearing part 8. The lubricant is a metal that is liquid at room temperature. This liquid metal can be an alloy containing gallium and/or indium and/or tin.

In the region of the bearing surfaces, spiral grooves can be provided in a known manner, at an orientation selected so that during the operation of the plain bearing they produce a capillary effect that holds the liquid metal in the interior of the bearing.

By means of screws, the rotor 16 of an electromotor provided for driving the rotating anode 1 is connected to the outer bearing part 8 (in FIG. 1, only the center lines, designated 15, of two screws are shown). The rotor 16 operates together with a stator 17 (shown schematically), the stator 17 being disposed on the outer wall of the vacuum housing 2 in the region of the rotor 16, and forms therewith an electrical squirrel-cage motor, which causes the rotating anode 1 to rotate when supplied with a corresponding current.

The bearing journal 6 is preferably fashioned cylindrically in its regions adjacent to the segments 6*a* and 6*b*. These cylindrically constructed segments 6*a* and 6*b* extend through the end segments of the bore of the outer bearing part 8, which are preferably also of cylindrical construction, and form therewith the end segments 18*a* and 18*b* of the bearing gap.

The arrangement is designed so that the outer diameter d1 of the end segment 18*a* of the bearing gap is equal to the outer diameter d2 of the end segment 18*b* of the bearing gap. The bearing gap thus has the same outer diameter at both its ends.

In this way, liquid metal is prevented from being able to escape from the bearing gap due to the centrifugal force acting during the rotation of the rotating anode 1, since, with respect to the effective centrifugal force field, there are no energy potential differences exhibited by the liquid metal that may be located in the two end segments of the bearing gap. On the contrary, due to the effect of centripetal force, during rotation of the rotating anode 1 the liquid metal collects in the region of the bearing gap provided for the transmission of force, and is held there.

Figure 3:
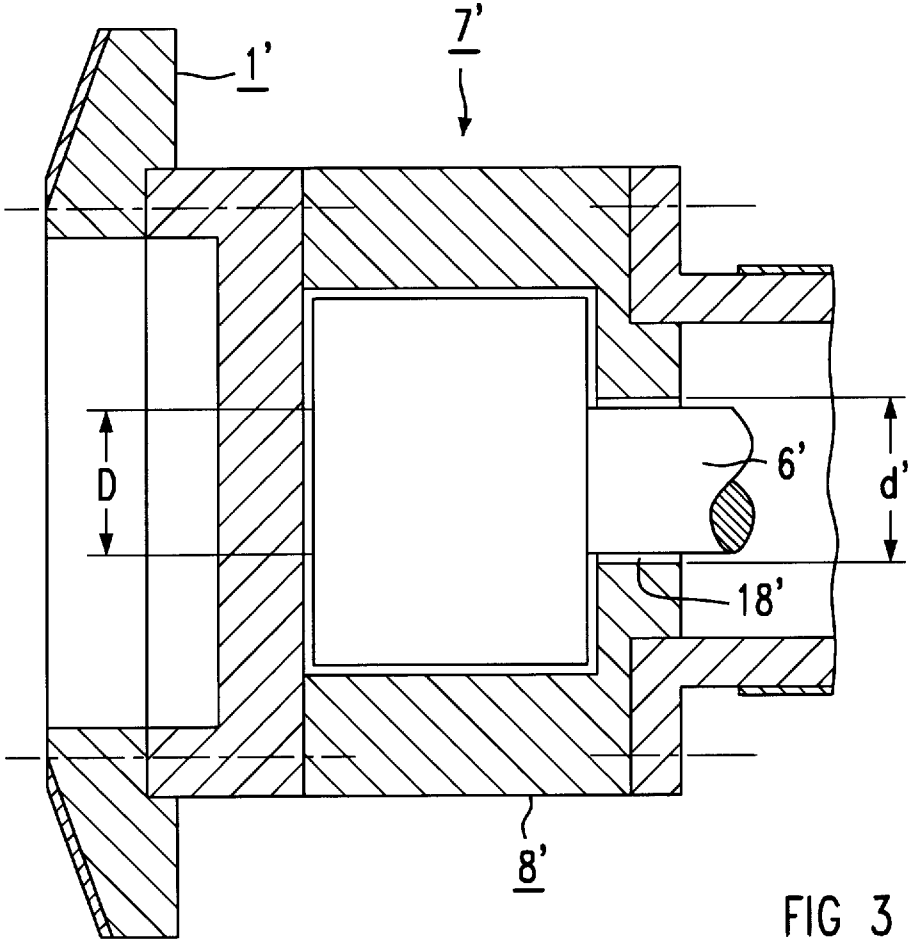
FIG. 3 shows a liquid metal plain bearing of a rotating anode X-ray tube according to the prior art in a view corresponding to FIG. 2.

Although in the invention the bearing gap is thus open on both sides, compared to a rotating anode 1' according to FIG. 3, mounted with a conventional plain bearing 7' open on one side, the danger of liquid metal escaping from the bearing gap is reduced considerably.

In such a conventional plain bearing 7', the liquid metal is located in the bearing gap between the base surface of the blind bore of the outer bearing surface 8' and the frontal surface, lying opposite, of the inner bearing part 6'. The liquid metal in such a conventional arrangement thus has an increased energy potential in the centrifugal force field that occurs during operation of the X-ray tube, relative to the liquid metal located in the end segment 18' of the bearing gap. As a result of the effective centrifugal forces, liquid metal is thus caused to migrate out of the bearing gap until there is a space free of liquid metal between the frontal surface of the inner bearing part 6' and the base surface of the outer bearing part 8', the diameter D of this space being equal to the outer diameter d of the end segment 18' of the bearing gap. The aforementioned space between the frontal surface of the inner bearing part 6' and the base surface of the bore of the outer bearing part 8' thus becomes empty during operation of the X-ray tube, and the corresponding quantity of liquid metal escapes the plain bearing 7'.

Figure 4:
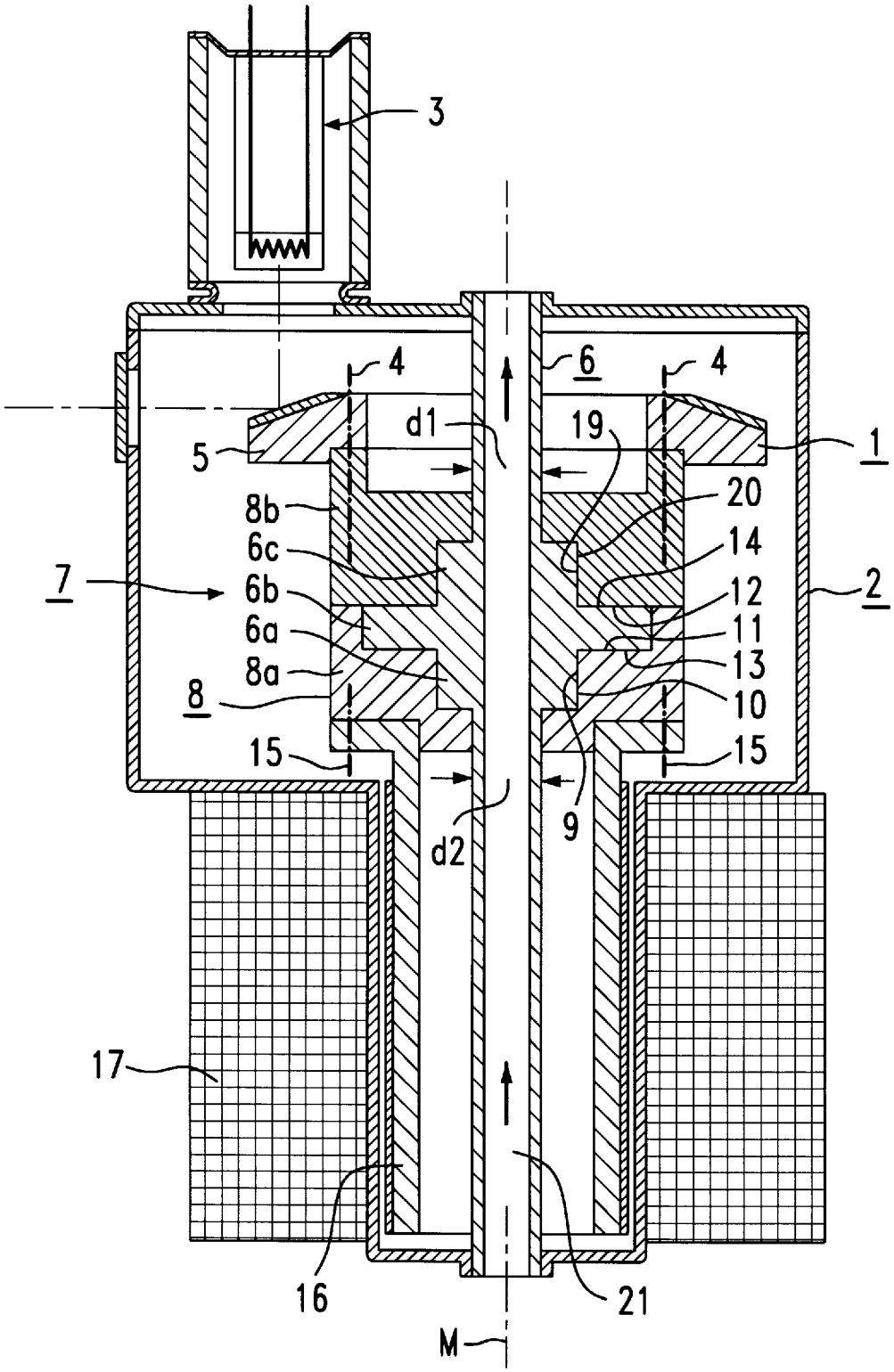
FIG. 4 shows a side view, partly in section, of a second embodiment of an inventive rotating anode X-ray tube with a liquid metal plain bearing.

The embodiment according to FIG. 4 differs from that according to FIGS. 1 and 2 in that a cylindrical segment 6*a* and 6*c* is located on both sides of the flange 6*b* of the bearing journal 6, this flange 66 being directed radially outwardly. The bearing journal 6 is thus enclosed in the bore of the inner bearing part 8 in such a way that two cylindrical bearing surface pairs, formed by the bearing surfaces 9 and 19 of the bearing journal 6 and with the bearing surfaces 10 and 20 of the outer bearing part 8, are produced for the transmission of forces that are radial in relation to the mid-axis M of the rotating anode 1. Two circularly annular bearing surface pairs are also produced, formed by the bearing surfaces 11 and 12 belonging to the bearing journal 6 and the bearing surfaces 13 and 14 belonging to the outer bearing part 8, for the transmission of forces directed axially in relation to the mid-axis M. Here as well, the outer diameters of the bearing surfaces of the circularly annular bearing surface pairs are greater than the diameters of the corresponding bearing surfaces of the cylindrical bearing surface pair.

As in the case of the previously specified exemplary embodiment, the outer diameters d1 and d2 of the end segments 18*a* and 18*b* of the bearing gap are equal, so that liquid metal located in the end segments of the bearing gap respectively exhibits the same energy potential in relation to the effective centrifugal force field produced during operation of the X-ray tube. Accordingly, there is practically no danger that liquid metal will escape from the bearing gap.

The bearing surfaces of the two cylindrical bearing surface pairs need not necessarily have the same diameter, in the way shown in FIG. 4.

Figure 5:
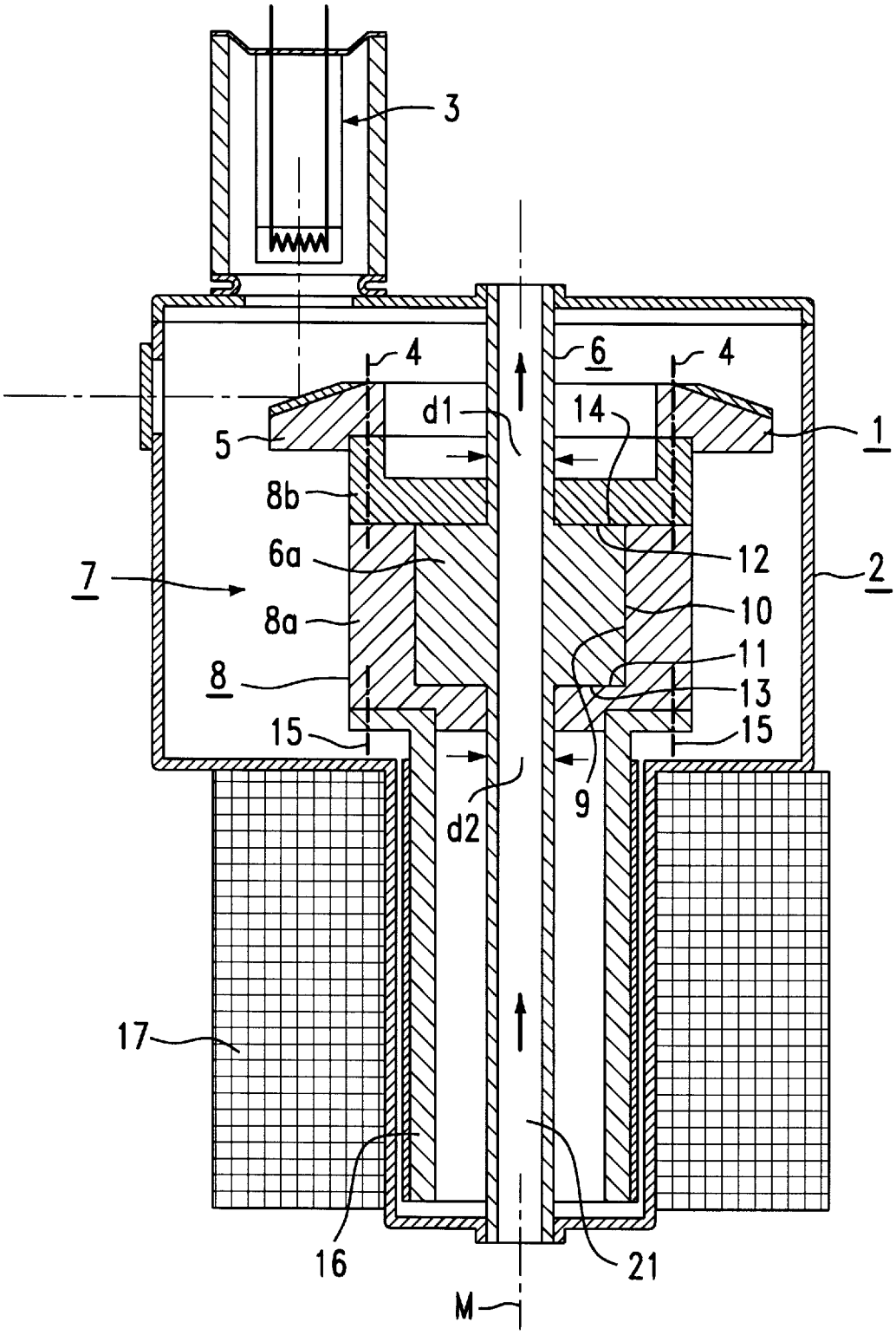
FIG. 5 shows a side view, partly in section, of a third embodiment of an inventive rotating anode X-ray tube with a liquid metal plain bearing.

In the case of the exemplary embodiment according to FIG. 5, the bearing journal 6 has only a thickening in the form of a cylindrical segment 6*a*, bounded at both ends by annularly circular frontal surfaces, in its region located in the bore of the outer bearing part 8. The bearing journal 6 is accordingly enclosed in the bore of the outer bearing part 8 in such a way that a cylindrical bearing surface pair formed by the bearing surface 9 of the bearing journal 6 and the bearing surface 10 of the outer bearing part 8 is produced for the transmission of forces that are radial in relation to the mid-axis M of the rotating anode 1. Two circularly annular bearing surface pairs, formed by the frontal surfaces, or bearing surfaces 11 and 12 belonging to the bearing journal 6 and the bearing surfaces 13 and 14 belonging to the outer bearing part 8, are provided for the transmission of forces directed axially in relation to the mid-axis M. The bearing surfaces of the annular bearing surface pairs thereby have an outer diameter that does not exceed that of the corresponding bearing surface of the cylindrical bearing surface pair.

All the exemplary embodiments have in common that as a consequence of the support provided on both sides of the bearing journal 6 in the vacuum housing 2, a mounting that is more rigid in comparison to a bearing journal supported on only one side can be realized. Smaller bending moments thus occur in comparison to a bearing journal supported only on one side, both in the region of the housing of the bearing journal in the vacuum housing 2 and in the bearing journal 6 itself.

Moreover, there is the possibility of providing the bearing journal with a continuous duct 21 as shown in each of FIGS. 1, 4 and 5, through which a cooling medium can flow, as indicated by arrows in these figures. In this way, an improved cooling can be achieved in comparison to X-ray tubes with bearing journals supported on one side, since, in contrast to the case of a bearing journal supported on one side, a deflection (reversal) of the direction of flow of the cooling agent is not required, and the flow losses associated such a the deflection are avoided.

Although the outer bearing part 8 is discussed above as having a "bore", this does not mean that this is necessarily manufactured by boring. In addition to boring, all other suitable manufacturing methods for manufacturing the bore are also possible.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray tube comprising:

an evacuated housing;

an anode assembly and a cathode assembly in said housing; and means for rotatably mounting said anode assembly in said housing including a plain bearing, said plain bearing comprising an inner bearing part having opposite ends connected to said housing so as to be stationary relative to said housing, a rotating outer bearing part connected to said anode assembly and rotatable therewith in said housing, said inner bearing part extending through said outer bearing part and forming a bearing gap therewith, liquid metal lubricant disposed in said gap at least in a region for transmission of force, said gap being substantially coextensive with said opposite ends of said inner bearing part and having an identical diameter at each of said ends.

2. An X-ray tube as claimed in claim 1 wherein said plain bearing comprises a cylindrical bearing surface pair and two annular bearing surface pairs disposed at opposite ends of said cylindrical bearing surface pair, said cylindrical bearing surface pair and said annular bearing surface pairs comprising said region for transmitting force in said bearing gap, said force being directed radially relative to an axis of rotation of said plain bearing, and said annular bearing surface pairs each having an outer diameter which does not exceed a diameter of a respective adjacent cylindrical bearing surface of said cylindrical bearing surface pair.

3. An X-ray tube as claimed in claim 1 wherein said plain bearing comprises a cylindrical bearing surface pair and two annular bearing surface pairs disposed at opposite ends of said cylindrical bearing surface pair, said cylindrical bearing surface pair and said annular bearing surface pairs comprising said region for transmitting force in said bearing gap, said force being directed radially relative to an axis of rotation of said plain bearing, and said annular bearing surface pairs each having an outer diameter which is greater than a diameter of a respective adjacent cylindrical bearing surface of said cylindrical bearing surface pair.

4. An X-ray tube as claimed in claim 1 wherein said claim bearing comprises two cylindrical bearing surface pairs and two annular bearing surface pairs disposed between said cylindrical bearing surface pairs, said two cylindrical surface bearing pairs and said two annular bearing surface pairs defining said region for transmitting force in said bearing gap, said force being directed radially relative to an axis of rotation of said plain bearing, and said two annular bearing surface pairs each having an outer diameter which is greater than a diameter of a cylindrical bearing surface of an adjacent one of said cylindrical surface bearing pairs.

* * * * *